US010501217B2

(12) United States Patent
Nascimento, Jr.

(10) Patent No.: US 10,501,217 B2
(45) Date of Patent: Dec. 10, 2019

(54) PACK FOR WRAPPING CONSUMER GOODS

(71) Applicant: POLENGHI INDUSTRIAS ALIMENTICIAS LTDA., Sao Paulo (BR)

(72) Inventor: Paulo Netto Nascimento, Jr., Sao Paulo (BR)

(73) Assignee: POLENGHI INDUSTRIAS ALIMENTICIAS LTDA., Sao Paulo (BR)

( * ) Notice: Subject to any disclaimer, the term of this patent is extended or adjusted under 35 U.S.C. 154(b) by 0 days.

(21) Appl. No.: 15/904,364

(22) Filed: Feb. 24, 2018

(65) Prior Publication Data

US 2018/0244411 A1 Aug. 30, 2018

(51) Int. Cl.

| | |
|---|---|
| ***B65D 5/54*** | (2006.01) |
| ***B65B 7/28*** | (2006.01) |
| ***B65B 5/04*** | (2006.01) |
| ***B65D 27/34*** | (2006.01) |
| ***B65D 77/26*** | (2006.01) |
| ***B65D 5/02*** | (2006.01) |
| *B65D 27/22* | (2006.01) |
| *B65D 75/58* | (2006.01) |

(52) U.S. Cl.

CPC ..... *B65B 7/2814* (2013.01); *B65B 5/04* (2013.01); *B65D 5/0254* (2013.01); *B65D 5/5445* (2013.01); *B65D 27/34* (2013.01); *B65D 77/26* (2013.01); *B65D 27/22* (2013.01); *B65D 75/5833* (2013.01)

(58) Field of Classification Search

CPC ..... B65D 7/2814; B65D 5/04; B65D 5/0254; B65D 5/5445; B65D 27/34; B65D 27/22; B65D 77/26

See application file for complete search history.

(56) References Cited

U.S. PATENT DOCUMENTS

| | | | | |
|---|---|---|---|---|
| 3,302,855 A * | 2/1967 | Becker | B65D 5/0005 | 229/101.1 |
| 5,669,493 A * | 9/1997 | Focke | B65D 5/5445 | 206/264 |
| 8,141,707 B2 * | 3/2012 | Robbins | B65D 5/545 | 206/447 |
| 8,950,658 B2 * | 2/2015 | Aldridge | B65D 5/18 | 206/38 |
| 2007/0063001 A1 * | 3/2007 | Sweet | A47G 21/001 | 229/101.2 |
| 2014/0048588 A1 * | 2/2014 | Ahsan | B65D 5/5475 | 229/101.1 |

* cited by examiner

*Primary Examiner* — Corey N Skurdal

(74) *Attorney, Agent, or Firm* — Steven M. Greenberg, Esq.; Shutts & Bowen LLP

(57) ABSTRACT

A pack includes at least one fold-line on one of the walls of the pack; at least one mechanically perforated front tear-line running from a first extremity of the fold-line to a second extremity of the fold-line and a mechanically perforated rear tear-line running from a first extremity of the fold-line to a second extremity of the fold-line, a mechanically perforated rear tear-line defining a separation between a first portion of the pack and a second portion of the pack; and a geometrically-shaped tab integrated with the second portion of the pack, a tab that can be folded along the fold-line and tucked into the pack through an opening defined by the mechanically perforated front tear-line.

7 Claims, 5 Drawing Sheets

PACK FOR WRAPPING CONSUMER GOODS

CROSS-REFERENCE TO RELATED APPLICATIONS

This application claims priority under 35 U.S.C. § 119(a) to Brazilian Patent Application No. 20 2017 003993 0, filed Feb. 24, 2017.

BACKGROUND OF THE INVENTION

Field of the Invention

The present invention relates to a pack for consumer goods.

Description of the Related Art

Today, a considerable increase is noted in the variety and availability of goods for immediate consumption or semi-prepared items in supermarkets and points of sale, mainly in large cities where people have increasingly less time available to prepare meals at home, due to heavy work and/or study routines. Because of these intensive routines, people seek ease, agility and commodity when eating a consumption item such as a quick snack or a meal.

In this context, some types of consumer goods packaging are designed not only to protect and present the product, but also to ensure easy consumption and storage thereof. More specifically, these packs are appropriate for storing consumer goods in single-unit packs or others holding one or more items, in a format that allows easy handling and transportation of the consumer item. Furthermore, in some cases, this format may allow the pack to be opened with no need for a specific utensil such as a knife, scissors or other cutting tool.

Particularly in terms of ease of opening the pack, the use of perforated lines is commonplace, allowing parts of the pack to be separated in order to allow easy access to the consumer item that it contains, using only the hands.

However, the packs known at the moment mean that consumption of the products they contain is not very practical after opening and accessing the item, forcing consumers to eat the entire content of the pack as a single sitting. Otherwise, the pack must be closed in an improvised manner by the consumer, or else the product may be contained too loosely in the pack, requiring consumers to carry around a large pack, regardless of the amount of product it contains. Another inconvenient aspect of the product being too loosely packed allows a product to move around in the pack, being crushed, broken or torn, due to the movement of the pack and resulting in consumption that is difficult or even not feasible.

BRIEF SUMMARY OF THE INVENTION

An object of the present invention is to provide a pack for consumer goods that can eliminate or at least lessen the constraints of the packs known at the state of the art.

Furthermore, another object of the invention is to provide a pack designed to allow it to be handled and opened without having to use a specific utensil such as a knife, scissors or other cutting tool.

Another object of the invention is to provide a pack designed to allow easy handling and opening of the pack and to allow a first closed position and a second closed position, for easier transportation consumption of the consumer item, compared to consumer goods contained in acts constituting the state of the art.

Yet another object of the invention is to provide a pack that allows the user to consume part of the contents contained in a pack and be able to store the rest in an optimized manner, in the smallest possible amount of space, ensuring that the product is properly wrapped.

The foregoing objects may be achieved through a pack for wrapping consumer goods that is comprised of: at least one fold-line on one of the walls of the pack; at least one mechanically perforated front tear-line running from a first extremity of the fold-line to a second extremity of the fold-line; the pack is also comprised of a mechanically perforated rear tear-line running from a first extremity of the fold-line to a second extremity of the fold-line, a mechanically perforated rear tear-line defining:

- a separation between a first portion of the pack and a second portion of the pack; and
- a geometrically-shaped tab integrated with the second portion of the pack, a tab that can be folded along the fold-line and tucked into the pack through an opening defined by the mechanically perforated front tear-line.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
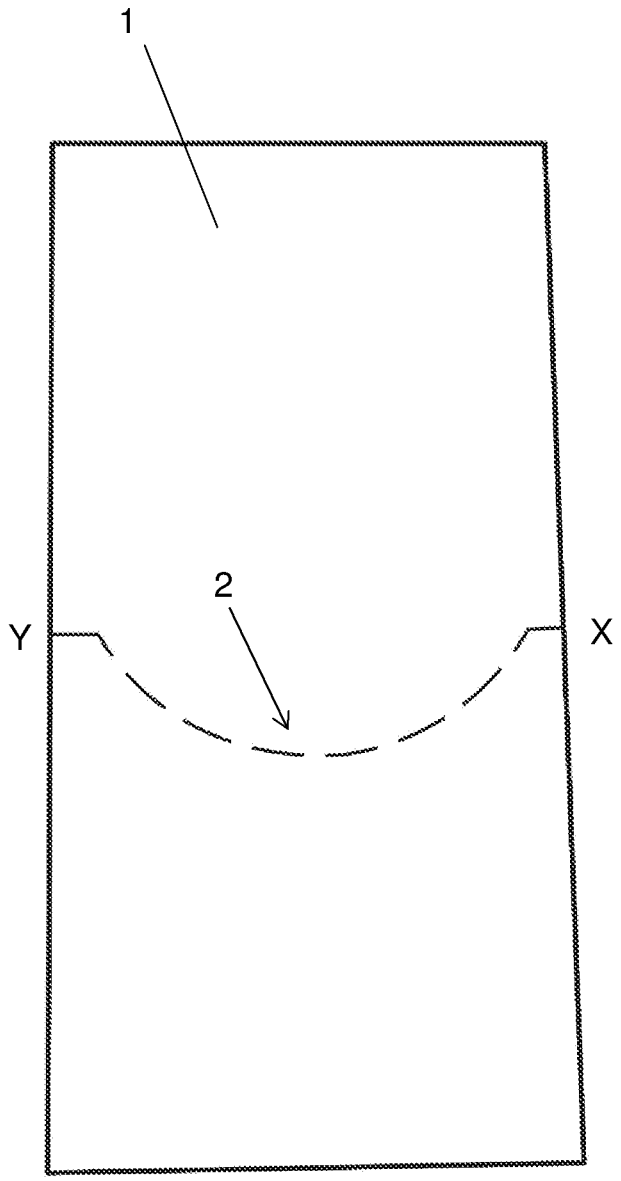
FIG. 1 shows a front view of a pack for wrapping consumer goods as set forth in a first specific materialization.
Figure 2:
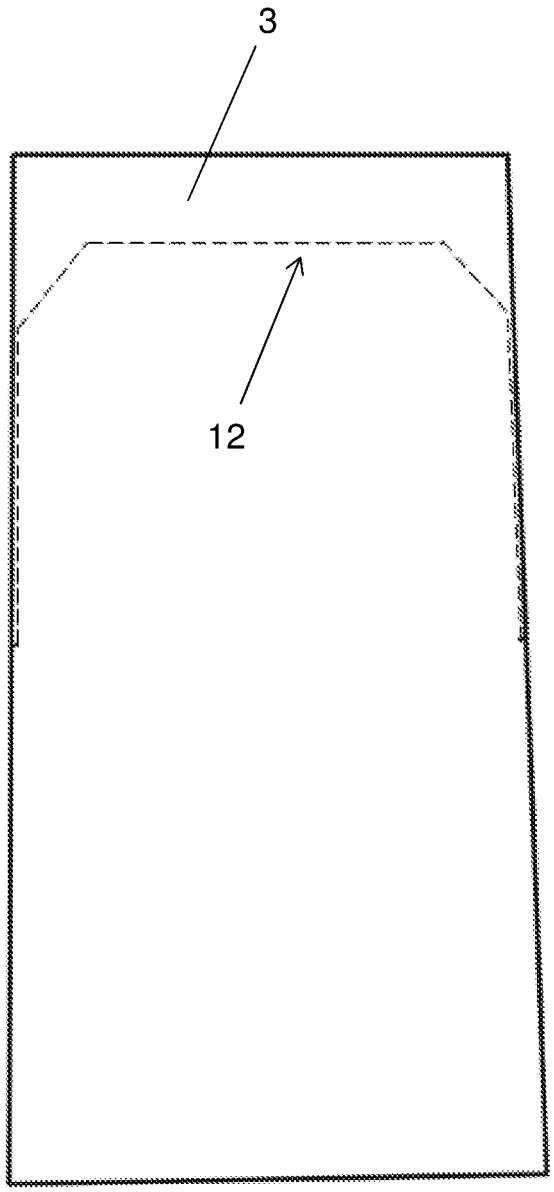
FIG. 2 shows a rear view of the pack in FIG. 1.
Figure 3:
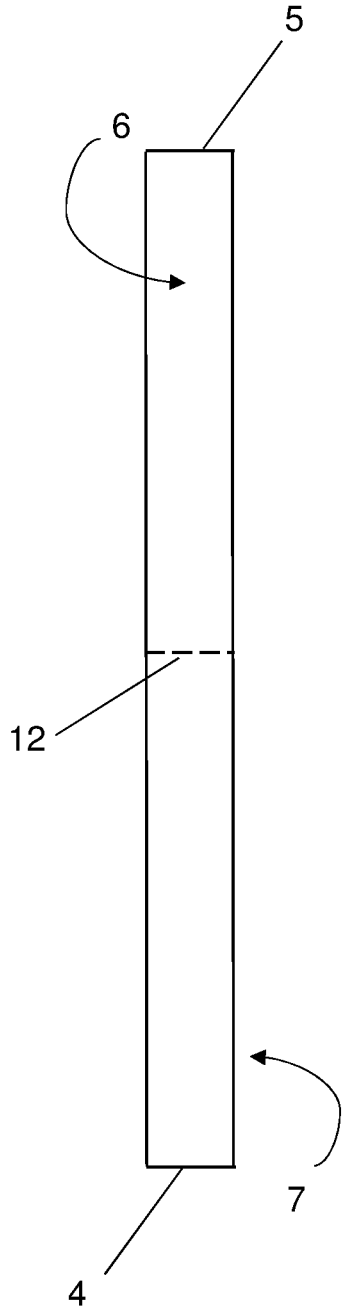
FIG. 3 shows a side view of the pack in FIG. 1.

As may be seen in FIGS. 1 to 3, the pack for wrapping items comprises an upper surface (1); a lower surface (3) facing the upper surface (1); a pair of longitudinal extremities (4, 5); a pair of lateral extremities (6, 7), where the upper surface (1) is connected to the lower surface (3) along the lateral (6, 7) and longitudinal (4, 5) extremities.

Moreover, as may be seen in FIGS. 1 and 2, the pack for wrapping consumer goods comprises on the upper surface (1) at least one mechanically perforated front tear-line (2) running from a first extremity (X) to a second extremity (Y)

and on the lower surface (3) a mechanically perforated rear tear-line (12) running from a first extremity (X) to a second extremity (Y).

Figure 4A:
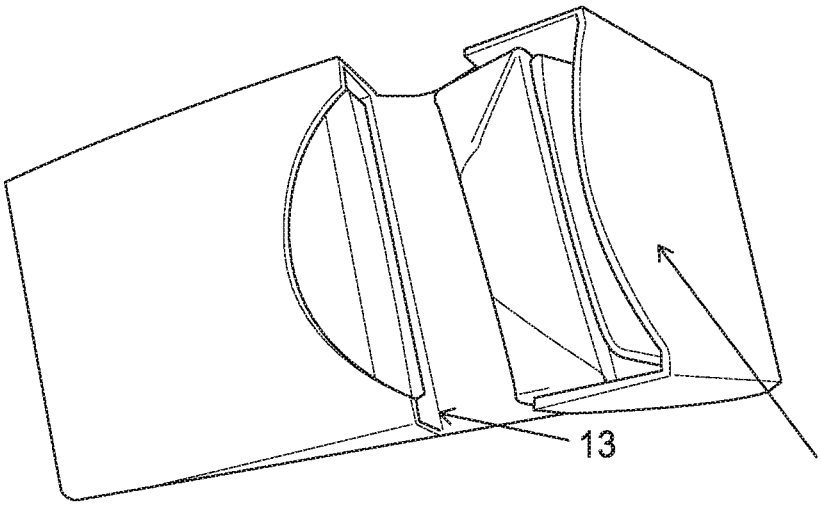
FIGS. 4*a* and 4*b* show the separation of the pack in FIG. 1.
Figure 4B:
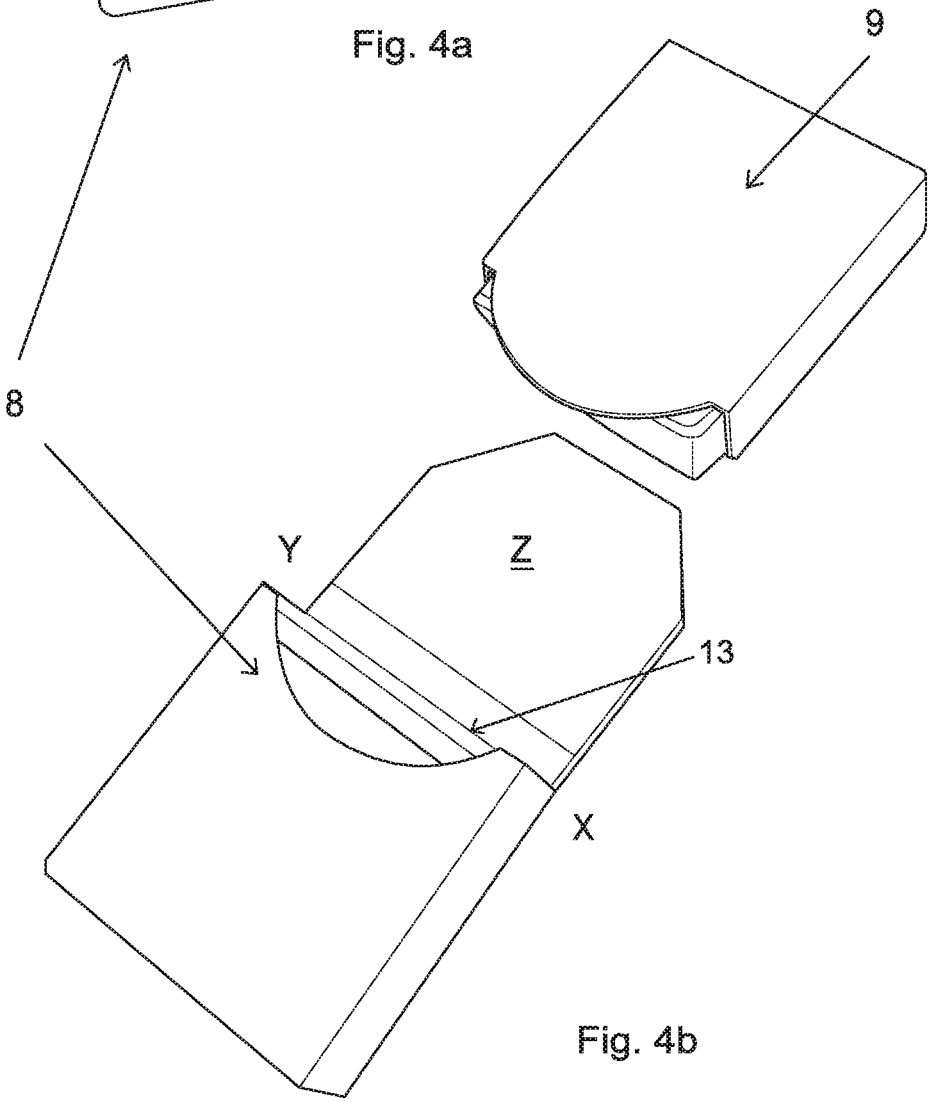
Figure 5:
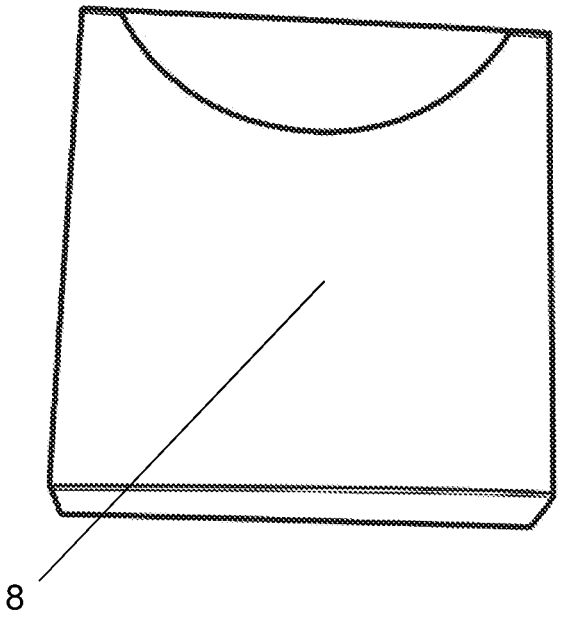
FIG. 5 shows a perspective view of the pack in which the tab is tucked into the pack.

Furthermore, as may be seen in FIGS. 4*a* and 4*b*, the pack for wrapping consumer goods comprises on the rear surface (3) at least one fold-line (13), a first portion (9) of the pack and a second portion (8) of the pack.

The mechanically perforated rear tear-lines (12) and fold-lines (13) define a separation between the first portion (9) of the pack and the second portion (8) of the pack.

Moreover, as may be seen in FIG. 4*b*, the pack for wrapping consumer goods comprises a geometrically-shaped tab (Z) integrated with the second portion (8) of the pack, a tab (Z) that can be folded along the fold-line (13) and tucked into the pack through an opening defined by the mechanically perforated front tear-line (2), allowing the second portion (8) of the pack, after separation from the first portion (9), to be closed through tucking the tab (Z) into the second portion (8).

Preferably, but not necessarily, the first extremity (X) and the second extremity (Y) of the fold-line (13) are positioned at intersections of the fold-line (13) with the corners of the pack.

Furthermore, and preferably, the pack for wrapping consumer goods comprises a plurality of fold-lines (13) connected to a plurality of mechanically perforated front tear-lines (2) and mechanically perforated rear tear-lines (12), defining a plurality of separable portions of the of the pack.

Finally, and preferably, a mechanically perforated front tear-line (2) defines a curved recess on the edge of the second portion (8) that is intended to ensure easier insertion and principally removal of the tab (Z) from inside the second portion (8).

Despite the description of the specific materialization is presented above, this utility model may be materialized in similar ways, with modifications to the manner of its implementation, whereby the scope of protection for the utility model is limited only by the content of the appended Claims, including possible equivalent variations related to the model presented in the Figures.

Having thus described the invention of the present application in detail and by reference to embodiments thereof, it will be apparent that modifications and variations are possible without departing from the scope of the invention defined in the appended claims as follows:

We claim:

1. A pack for wrapping consumer goods comprising:

at least one fold-line on a wall of the pack;

at least one mechanically perforated front tear-line running from a first extremity of the fold-line to a second extremity of the fold-line; and, a mechanically perforated rear tear-line running from a first extremity of the fold-line to a second extremity of the fold-line, with the mechanically perforated rear tear-line defining:

a separation between a first portion of the pack and a second portion of the pack; and a geometrically-shaped tab integrated with the second portion of the pack, the tab being adapted for folding along the fold-line and tucked into the pack through an opening defined by the mechanically perforated front tear-line.

2. The pack according to claim 1, wherein the first extremity and the second extremity of the fold-line are positioned at intersections between the fold-line and a multiplicity of corners of the pack.

3. The pack according to claim 2, further comprising a plurality of fold-lines connected to a plurality of mechanically perforated front tear-lines and mechanically perforated rear tear-lines, defining a plurality of separable portions of the pack.

4. The pack according to claim 2 wherein the mechanically perforated front tear-line defines a curved recess on an edge of the second portion.

5. The pack according to claim 1, further comprising a plurality of fold-lines connected to a plurality of mechanically perforated front tear-lines and mechanically perforated rear tear-lines, defining a plurality of separable portions of the pack.

6. The pack according to claim 5 wherein the mechanically perforated front tear-line defines a curved recess on an edge of the second portion.

7. The pack according to claim 1 wherein the mechanically perforated front tear-line defines a curved recess on an edge of the second portion.

* * * * *